US008481466B2

(12) United States Patent
Kim et al.

(10) Patent No.: US 8,481,466 B2
(45) Date of Patent: Jul. 9, 2013

(54) BIODEGRADABLE GREASE COMPOSITION USING DISTILLATION RESIDUE GENERATED IN PRODUCTION OF BIODIESEL

(75) Inventors: Kwang Soon Kim, Sunjang-myun (KR); Moon Sik Lee, Buchun-si (KR)

(73) Assignee: Korea Houghton Corporation, Choongchungnam-Do (KR)

( * ) Notice: Subject to any disclaimer, the term of this patent is extended or adjusted under 35 U.S.C. 154(b) by 893 days.

(21) Appl. No.: 11/901,878

(22) Filed: Sep. 20, 2007

(65) Prior Publication Data

US 2008/0171676 A1 Jul. 17, 2008

(30) Foreign Application Priority Data

Jan. 12, 2007 (KR) ..... 10-2007-0003691
Jan. 12, 2007 (KR) ..... 10-2007-0003692

(51) Int. Cl.
*C10M 169/06* (2006.01)
*C10M 105/32* (2006.01)

(52) U.S. Cl.
USPC ..... 508/491; 508/463; 508/459

(58) Field of Classification Search
USPC ..... 508/135, 136, 459, 491, 463
See application file for complete search history.

(56) References Cited

U.S. PATENT DOCUMENTS

| | | | | | |
|---|---|---|---|---|---|
| 3,923,702 | A * | 12/1975 | Sturwold et al. | ..... | 508/135 |
| 5,487,839 | A * | 1/1996 | Vinci et al. | ..... | 508/188 |
| 6,010,984 | A * | 1/2000 | Heimann et al. | ..... | 508/136 |
| 6,020,290 | A * | 2/2000 | Takata et al. | ..... | 508/364 |
| 6,656,888 | B1 * | 12/2003 | Zehler | ..... | 508/485 |

* cited by examiner

*Primary Examiner* — Pamela H Weiss
(74) *Attorney, Agent, or Firm* — Rabin & Berdo, P.C.

(57) ABSTRACT

A grease composition using lubricating base oil that is biodegradable by microorganisms in nature and has an affinity to the human body is provided. More particularly, a distillation residue secondarily generated in production of biodiesel from vegetable oil (soybean oil and canola oil) is used as the lubricating base oil.

The grease composition is produced by adding 1 to 20 wt % of additives to 100 to 95 wt % of distillation residues, which is generated in production of biodiesel, and 1 to 30 wt % of thickeners.

8 Claims, No Drawings

BIODEGRADABLE GREASE COMPOSITION USING DISTILLATION RESIDUE GENERATED IN PRODUCTION OF BIODIESEL

CROSS-REFERENCE TO RELATED APPLICATION

This application claims the benefit of Korean Patent Application No. 10-2007-0003691 filed on Jan. 12, 2007, the disclosure of which is hereby incorporated herein by reference in its entirety.

BACKGROUND OF THE INVENTION

1. Field of the Invention

The present invention relates to a grease for lubricating machinery, equipment or instruments used in general industry, and more particularly, to a grease composition produced using, as base oil, 10 to 95 wt % of final residues which is generated in production of biodiesel using deodorized distillates of soybean oil and canola oil.

2. Description of the Related Art

<Components and Classification of Common Grease>

| | Component | Content | Subject 1 | Subject 2 | Subject 3 |
|---|---|---|---|---|---|
| COMPSITION OF GREASE | Base Oil | 50-95% | Petroleum Hydrocarbon | Petroleum Distilled Mineral Oil-Paraffin-based, Naphthene-based, etc. | For central refueling For multi-purposes For high-weight |
| | | | Synthetic Oil | PAO-based, Ester-based, Poly Glycol-based, Silicone-based, Fluorine-based, etc. | Synthetic Oil Grease, Low Temperature Grease (Dewax) |
| | Thickener | 3-30% | Soap | Formation of soap by reaction between metal hydroxide such as Ca, Li, Al, etc. and fatty acid | Lithium and Lithium Complex Grease, Aluminum Complex Grease, Calcium Complex Grease |
| | | | Non-Soap | Urea, Silica Gel, Bentone | Urea Grease, Bentone Grease, Silica Gel Grease |
| | Additive | 3-30% | Additive | Anti-Oxidation, Lubrication improvement Rust Inhibitor, Structure Stabilizer | |
| | | | Filler | Carbon Black, Zinc Oxide | |
| | | | Solid Lubricant | Graphite, Molybdenum Disulfide, etc. | Molybdenum Paste, Fluoro (silicone) Grease |

The lubricating grease is classified into a metal soap grease such as Ca, Na, Li, Al, Ba or its complex grease and a non-soap grease such as bentone, silica, urea, graphite or PTFE according to the kind of the thickener, and classified into a mineral oil grease and a synthetic oil grease according to the kind of a base oil.

The greases preserve performance and lifespan of lubricating units and equipment by reducing friction between units in a lubricating region, reducing wear in metals, enhancing characteristics of a lubricating surface, reducing adhesion to a metal surface and melting, preventing deformation due to heat by removing the heat, and maximizing prevention of impurity injection and sealing effect. The petroleum hydrocarbon lubricating base oil, which is produced in the final step of the common crude oil refining process, is generally used as base oil for grease. However, grease using the petroleum hydrocarbon may cause environmental damage, and may threaten the health of a human who uses the grease.

Recently, as interest in the importance of environmental protection and the health and safety of workers has been increasing, research on environmentally acceptable lubricating base oils which will substitute for the hydrocarbon lubricating base oil of this grease is progressing in North American and Western European nations.

According to this trend, the present invention is directed to developing a grease composition using a distillation residue generated in the production of biodiesel as environmentally friendly lubricating base oil.

Biodiesel refers to an alternative energy processed from elemental lipid in vegetables and animals to have similar properties to gasoline, which can be used as a diesel equivalent or for diesel engines by being mixed with the gasoline. In general, biodiesel refers to fatty acid methyl esters having a purity of 95% made from the transesterification between alcohols (generally, methanol) and vegetable oil (rice bran, waste cooking oil, soybean oil, rape oil, etc.). (Ministry of Commerce, Industry and Economy (MOCIE) Announcement No. 2000-57)

The vegetable oil described above, that is, a compound including a hydrophobic group insoluble in water, is generally composed of triglycerides represented as the following chemical structural formula.

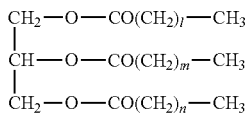

The vegetable oil is commonly characterized by the content of the fatty acid, and the length, content and saturation degree of the fatty acid become critical factors in determining physical and chemical characteristics of the oil. Animal oil is less useful than the vegetable oil, and only that made from a pig, a cow and a sheep among land animals, and herring and menhaden among fishes are considered as being commercially important. The animal oils are composed of saturated and unsaturated triglycerides like the vegetable oils, but include a wide distribution of fatty acids and some odd-numbered chain fatty acids, unlike the vegetable oils.

When methyl ester made from vegetable oil, that is, biodiesel, is spilled on soil, the soil is less polluted than by hydrocarbon-base lubricating base oil, because of lower toxicity and higher biodegradation. Also, corresponding to United Nations Framework Convention on Climate Change (UNFCCC) (Life cycle $CO_2$: ¼ of gasoline), one (1) ton of the methyl ester from vegetable oil cuts 2.2 tons of $CO_2$, which contributes to an increase in global competitiveness. The methyl ester from vegetable oil is mainly made of methyl oleate and methyl linoleate as main components, and exhibits excellent performance in machinability or detergency due to low viscosity (40° C., 1.9 to 6.0 cSt.) and good lubrication when used instead of petroleum-based hydrocarbon lubricating base oil.

$CH_3—(CH_2)_{14}—COO—CH_3$: Methyl Palmitate $CH_3—(CH_2)_6—CH_2—CH=CH—CH_2—(CH_2)_6—COO—CH_3$: Methyl Oleate $CH_3—(CH_2)_3—CH_2—CH=CH—CH_2—CH=CH—CH_2—(CH_2)_6—COO—CH_3$: Methyl Linoleate The methyl ester from vegetable oil is made by the following processes.

<Transesterification>

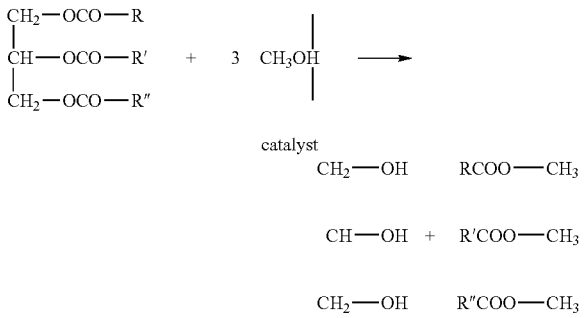

<Esterification>

$$R—COOH+CH_3OH \rightarrow R—COOCH_3$$

Catalyst

Here, R, R' and R" are saturated or unsaturated hydrocarbons with alkyl groups.

<Compositions of Fatty Acids of Canola Oil and Soybean Oil for Producing Biodiesel>

| Fatty Acid Fatty Oil and Oils | C16:0 | C16:1 | C18:0 | C18:1 | C18:2 | C18:3 | C20:0 C22:0 | C20:1 | C22:1 |
|---|---|---|---|---|---|---|---|---|---|
| Canola Oil | — | 2-5% | 0.2% | 1-2% | 10% | 10% | 5-10% | 0.9% | 50% |
| Soybean Oil | 0.3% | 7-10% | 0-1% | 3-6% | 22-34% | 50-60% | 2-10% | 5-10% | — |

<Chemical Structure of Fatty Acid Used in Production of Grease>

| Name of Fatty Acid | Carbon Number | Double Bond Number | Chemical Structure |
|---|---|---|---|
| Palmitic Acid | 16 | 0 | $COCH_3(CH_2)_{14}COOH$ |
| Palmitoleic Acid | 16 | 1 | $CH_3(CH_2)_5CH=CH(CH_2)_7COOH$ |
| Stearic Acid | 18 | 0 | $CH_3(CH_2)_{16}COOH$ |
| Oleic Acid | 18 | 1 | $CH_3(CH_2)_7CH=CH(CH_2)_7COOH$ |
| Linoleic Acid | 18 | 2 | $CH_3(CH_2)_4CH=CHCH_2CH=CH(CH_2)_7COOH$ |
| Linolenic Acid | 18 | 3 | $CH_3(CH_2)_2CH=CHCH_2CH=CH(CH_2)CH=CH(CH_2)_7COOH$ |
| Arachldic Acid | 20 | 0 | $CH_3(CH_2)_{18}COOH$ |
| Eicosenoic Acid | 20 | 1 | $CH_3(CH_2)_7CH=CH(CH_2)_9COOH$ |
| Behenic Acid | 22 | 0 | $CH_3(CH_2)_{20}COOH$ |
| Erucic Acid | 22 | 1 | $CH_3(CH_2)_7CH=CH(CH_2)_{11}COOH$ |

<Comparison of Biodegradation of Vegetable Oil and Synthetic Ester Base Oil, CEL-L-33-A-93 Method>

| Order | Soybean Oil | Rapeseed Oil | Synthetic Ester | Petroleum Hydrocarbon (Mineral oil) |
|---|---|---|---|---|
| 1 | 96.5% | 97.0% | 96.4% | 19.7% |
| 2 | 97.2% | 99.0% | 97.2% | 18.9% |
| Average | 96.9% | 97.5% | 96.8% | 19.3% |

Components and ratios of vegetable oil methyl ester depend on components and composition ratios of fatty acid of the vegetable oil. The methyl ester of the fatty acid listed in Table 1 is a component of the vegetable oil methyl ester.

<Chemical Structure of Fatty Acid Used in Biodegradable Grease Made From Vegetable Oil>

| Name of Fatty Acid | Carbon Number/ Double Bond Number | Chemical Structure |
|---|---|---|
| Caprylic | C8 | $CH_3(CH_2)_6COOH$ |
| Capric | C10 | $CH_3(CH_2)_8COOH$ |
| Lauric | C12 | $CH_3(CH_2)_{10}COOH$ |
| Myristric | C14 | $CH_3(CH_2)_{12}COOH$ |
| Palmitic | C16:0 | $CH_3(CH_2)_{14}COOH$ |
| Palmitoleic | C16:1 | $CH_3(CH_2)_5CH{=}CH(CH_2)_7COOH$ |
| Stearic | C18:0 | $CH_3(CH_2)_{16}COOH$ |
| Oleic | C18:1 | $CH_3(CH_2)_7CH{=}CH(CH_2)_7COOH$ |
| Linoleic | C18:2 | $CH_3(CH_2)_4CH{=}CHCH_2CH{=}CH(CH_2)_7COOH$ |
| Linolenic | C18:3 | $CH_3(CH_2)_2CH{=}CHCH_2CH{=}CHCH_2CH{=}CH(CH_2)_7COOH$ |
| Arachidic | C20:0 | $CH_3(CH_2)_{18}COOH$ |
| Eicosenoic | C20:1 | $CH_3(CH_2)_7CH{=}CH(CH_2)_9COOH$ |
| Behenic | C22:0 | $CH_3(CH_2)_{20}COOH$ |
| Erucic | C22:1 | $CH_3(CH_2)_7CH{=}CH(CH_2)_{11}COOH$ |

Vegetable oils capable of synthesizing the methyl esters from vegetable oil which may be used in the present invention are listed in the following table.

<Fatty Acid Components of Vegetable Oil Used in Formation of Biodiesel>

| Fatty acid, Fatty oil and oil | C8:0 | C10:0 | C14:0 | C16:0 | C16:1 | C18:0 | C18:1 | C18:2 | C18:3 | C20:0 C22:0 | C20:1 C22:1 | |
|---|---|---|---|---|---|---|---|---|---|---|---|---|
| Coconut oil | 5-9 | 4-10 | 44-51 | 13-18 | 7-10 | — | 1-4 | 5-8 | 1-3 | — | — | — |
| Palm Kernal Oil | 2-4 | 3-7 | 45-52 | 14-19 | 6-9 | 0-1 | 1-3 | 10-18 | 1-2 | — | 1-2 | — |
| Palm Oil | — | — | — | 1-6 | 32-47 | — | 1-6 | 40-52 | 2-11 | — | — | — |
| Soybean Oil | — | — | — | 0.3 | 7-11 | 0-1 | 3-6 | 22-34 | 50-60 | 2-10 | 5-10 | — |
| Jatropha Oil | — | — | — | 35-50 | — | 0-10 | 30-40 | 5-15 | — | — | — | — |
| Canola Oil | — | — | — | — | 2-5 | 0.2 | 1-2 | 10-15 | 10-20 | 5-10 | 0.9 | 50-60 |

Biodiesel may be mixed with gasoline and then used, or 100% pure biodiesel may be used. BD5 refers to a mixture of 95% gasoline and 5% biodiesel, and BD20 refers to a mixture including 20% biodiesel. Biodiesel attracts attention around the world as a future energy source in the aspects of recycling of waste resources, reduction of greenhouse gas ($CO_2$), and low emission of air pollutants. Recently, biodiesel is in exemplary use or is expanding its supply through model projects all over the world. Europe, which is very positive towards the use of alternative energy, first established a system for biodiesel. Europe recognizes that biodiesel can be used within a range satisfying the standard of general gasoline, and according to European Fuel Standard (EN590) taken effect in January, 2004, gasoline including 5% biodiesel or less (BD5) is recognized as general gasoline (satisfying the requirements of the EN14214 standard). In the U.S., after National Biodiesel Board was founded in 1992, the Congress and EPA approved BD20 as a fuel for diesel engine vehicles in 1998, and the U.S. President declared the expansion of new recycled energy including biodiesel in 2001. According to the active announcement of the government, the supply of biodiesel is increasing every year, and biodiesel is used in official vehicles of state governments and buses in addition to the U.S. Army, the U.S. Air Force, the Department of Energy and NASA. In Korea, based on the announcement regarding a model supply project for biodiesel by MOCCC in May, 2002, the government performed the project for two years, and now is investigating market reaction and problems with biodiesel. The major advantage of biodiesel is a reduction of smoke emitted from vehicles. Although biodiesel also emits the greenhouse gas $CO_2$, when viewed from an overall cycle of the process (from production to consumption) it yields very low amounts of $CO_2$, and emits relatively low amounts of sulfur oxide (Sox) and particulate matters (PMs). Biodiesel made from vegetable resources may be self-produced domestically, which is an advantage for energy security, and may reduce environmental pollution by recycling waste resources, such as waste cooking oil. Also, in the aspect of infrastructure, diesel engine or gas station networks may be used, and thus less additional cost is required. However, although such advantages can be expected, biodiesel has several problems in substituting for conventional gasoline and volatile oils. Although biodiesel has to be mixed in a high ratio to reduce toxic chemicals in exhaust gases from vehicles, it may break down engines due to corrosion, and become denatured in long-term storage.

For these reasons, high purity products are required for methyl esters made from vegetable oil to be used as fuel oils for vehicles, and thus a separate vacuum distillation process is performed after the reaction of methyl esters. The vacuum distillation is performed at 2 to 3 torrs and a maximum temperature of 240° C. After the vacuum distillation process, the distilled result is used as biodiesel fuel oil, and a distillation residue of about 10% is scrapped. Such a distillation residue generated in the production of biodiesel is a reactant of the vegetable oil with a structure of ester, and may be used as environmentally friendly lubricating base oil.

SUMMARY OF THE INVENTION

An embodiment of the invention provides a grease composition formed by using a distillation residue generated when biodiesel of soybean oil and canola oil is produced as lubricating base oil of the biodegradable grease and then adding other thickeners and additives to the result.

The thickener includes lithium soap, urea, aluminum complex soap or bentonite, and the additive includes a pour point depressant, a lubricating additive, a structure stabilizer, an oxidation inhibitor, or a corrosion inhibitor. Here, the additives are those having less effect on the environment and not including any of components with restrictions in use such as nitrite, formaldehyde and derivatives thereof, and petroleum hydrocarbon.

In one aspect, the present invention is directed to an industrial lubricating grease for machinery and equipment, and more particularly, to a grease composition produced by adding 3 to 30 wt % additives to 10 to 95 wt % distillation residues, which is generated in production of biodiesel, and 3 to 30 wt % thickeners.

The distillation residue of biodiesel of the present invention is generated from soybean oil or rapeseed oil.

The thickener used in the present invention includes at least one selected from the group consisting of lithium soap, aluminum soap, diurea, bentone and silica gel.

The lithium and aluminum soaps include lithium and aluminum metals, and soaps formed by soponification between 12-hydroxy stearic acid, stearic acid, boric acid or benzoic acid and $H_2O$.

The urea thickener includes a diurea product, formed by a reaction between one selected from the group consisting of a tolylene diisocyanate compound, diisocyanate compounds such as diphenylmethane diisocyanate and naphthalene diisocyanate, and one selected from the group consisting of monoamines such as benzylamine, toluidine and chloroaniline, tetradecylamine, pentadecylamine, hexadecylamine, heptadecylamine, octadecylamine, nonyldecylamine and eicosylamine.

The bentone thickener includes bentonite and a self-activator such as alcohol or water.

The silica gel thickener is fumed silica which includes hydrophobic and hydrophilic silicas.

The additive used in the present invention includes at least one selected from the group consisting of a pour point depressant, a lubricating additive, a corrosion inhibitor, an oxidation inhibitor, a structure stabilizer and a thickener.

The pour point depressant used in the present invention includes polymethacrylate, aromatic synthetic base oil or derivatives thereof.

The lubricating additive includes metal salts of dithiocarbamate, aryl phosphate and phosphoric ester, sulfide or derivatives thereof.

The corrosion inhibitor includes benzotriazole, tolyltriazole, mercaptobenzothiazole or derivatives thereof.

The oxidation inhibitor includes tetrabutylmethylphenol, a quinoline compound or derivatives thereof.

The structure stabilizer includes a copolymer such as ethylene propylene or derivatives thereof.

The thickener includes derivatives of polybutene or polyisobutylene.

DETAILED DESCRIPTION OF THE INVENTION

Greases were formed using a distillation residue of biodiesel as lubricating base oil by four thickeners, and then their properties and performances were measured.

Exemplary Embodiment 1

Lithium Thickener

A lithium soap grease was produced using a distillation residue generated in production of biodiesel, lithium soap (a soponification product of lithium hydroxide and fatty acid such as 12-hydroxy stearic acid, stearic acid, azelaic acid or boric acid), a pour point depressant, a lubricating additive, a corrosion inhibitor, an oxidation inhibitor, a structure stabilizer and a thickener.

TABLE 1

Composition and Properties of Lithium Soap Grease

| Amount (%) | Name | 1 | 2 | 3 |
|---|---|---|---|---|
| | Fatty Acid | 6.0 | 4.0 | 2.0 |
| | Lithium Hydroxide | 0.9 | 0.6 | 0.3 |
| | Biodiesel distillation residue | 82.0 | 83.0 | 85.0 |
| | Pour Point depressant | 1.0 | 1.0 | 1.0 |
| | Lubricating Additive | 1.0 | 1.0 | 1.0 |
| | Thickener | 8.0 | 9.0 | 9.0 |
| | Etc. | Proper quantity | Proper quantity | Proper quantity |
| Property | Categories | | | |
| | Worked Penetration | 330 | 367 | 421 |
| | Dropping Point (°C.) | 170 | 162 | 159 |
| | 4-ball Test (Shell Method), mm | 0.6 or less | 0.6 or less | 0.6 or less |
| | Oil Separation % (100 °C., 24 h) | 4.5 | 6.5 | 9.0 |
| | Copper Corrosion (100 °C., 24 h) | No color change | No color change | No color change |

Exemplary Embodiment 2

Urea Thickener

A urea grease was produced using a distillation residue generated in production of biodiesel, a urea thickener (diurea, a tolylene diisocyanate compound, a diisocyanate compound of diphenylmethane diisocyanate or naphthalene diisocyanate, monoamine of benzylamine, toluidine or chloroaniline, or an aromaticamine such as tetradecylamine, pentadecylamine, hexadecylamine, heptadecylamine, octadecylamine, nonyldecylamine or eicosylamine), a pour point depressant, a lubricating additive, a corrosion inhibitor, an oxidation inhibitor and a structure stabilizer.

TABLE 2

Composition and Properties of Urea Grease

| Amount (%) | Name | 1 | 2 | 3 |
|---|---|---|---|---|
| | Diisocyanate | 10.0 | 8.0 | 6.0 |
| | Aromatic amine | 10.0 | 8.0 | 6.0 |
| | Biodiesel Distillation Residue | 68.0 | 70.0 | 74.0 |
| | Pour Point Depressant | 1.0 | 1.0 | 1.0 |
| | Lubricating Additive | 1.0 | 1.0 | 1.0 |

TABLE 2-continued

| Composition and Properties of Urea Grease | | | | |
|---|---|---|---|---|
| Amount (%) | Name | 1 | 2 | 3 |
| | Water-Resistance Additive | 1.0 | 1.0 | 1.0 |
| | Thickener | 8.0 | 9.0 | 9.0 |
| | Etc. | Proper quantity | Proper quantity | Proper quantity |
| Property | Categories | | | |
| | Worked Penetration | 290 | 335 | 360 |
| | Dropping Point (°C.) | 260 | 255 | 252 |
| | 4-ball Test (Shell Method), mm | 0.6 or less | 0.6 or less | 0.6 or less |
| | Oil Separation % (100 °C., 24 h) | 3.0 | 4.3 | 5.8 |
| | Copper Corrosion (100 °C., 24 h) | No color change | No color change | No color change |

Exemplary Embodiment 3

Aluminum Thickener

An aluminum complex grease was produced using a distillation residue generated in production of biodiesel, an aluminum complex thickener (an aluminum metal compound, and a fatty acid such as benzoic, palmitic, palmitoleic, stearic, oleic or linoleic acid), a pour point depressant, a lubricating additive, a corrosion inhibitor, an oxidation inhibitor and a structure stabilizer.

TABLE 3

| Composition and Properties of Aluminum Grease | | | | |
|---|---|---|---|---|
| Amount (%) | Name | 1 | 2 | 3 |
| | Aluminum Isopropoxide | 8.0 | 6.0 | 4.0 |
| | Stearic Acid | 11.0 | 8.3 | 5.6 |
| | Benzoic Acid | 4.8 | 3.6 | 2.4 |
| | Water ($H_2O$) | 0.7 | 0.5 | 0.3 |
| | Biodiesel Distillation Residue | 63.5 | 68.6 | 74.7 |
| | Pour Point Depressant | 1.0 | 1.0 | 1.0 |
| | Lubricating Additive | 1.0 | 1.0 | 1.0 |
| | Water-Resistance Additive | 1.0 | 1.0 | 1.0 |
| | Thickener | 8.0 | 9.0 | 9.0 |
| | Etc. | Proper quantity | Proper quantity | Proper quantity |
| Property | Categories | | | |
| | Worked Penetration | 275 | 312 | 363 |
| | Dropping Point ( °C.) | 261 | 258 | 247 |
| | 4-ball Test (Shell Method), mm | 0.6 or less | 0.6 or less | 0.6 or less |
| | Oil Separation % (100 °C., 24 h) | 2.5 | 3.7 | 4.1 |
| | Copper Corrosion (100 °C., 24 h) | No color change | No color change | No color change |

Exemplary Embodiment 4

Bentone Thickener

A bentone grease was produced using a distillation residue generated in production of biodiesel, a bentone thickener, a pour point depressant, a lubricating additive, a corrosion inhibitor, an oxidation inhibitor and a structure stabilizer.

TABLE 4

| Composition and Properties of Bentone Grease | | | | |
|---|---|---|---|---|
| Amount (%) | Name | 1 | 2 | 3 |
| | Bentonite | 10.0 | 8.0 | 6.0 |
| | Methanol | 0.1 | 0.1 | 0.1 |
| | Biodiesel Distillation Residue | 78.0 | 79.0 | 81.0 |
| | Pour Point Depressant | 1.0 | 1.0 | 1.0 |
| | Lubricating Additive | 1.0 | 1.0 | 1.0 |
| | Water-Resistance Additive | 1.0 | 1.0 | 1.0 |
| | Thickener | 8.0 | 9.0 | 9.0 |
| | Etc. | Proper quantity | Proper quantity | Proper quantity |
| Property | Categories | | | |
| | Worked Penetration | 288 | 317 | 356 |
| | Dropping Point (°C.) | None | None | None |
| | 4-ball Test (Shell Method), mm | 0.7 or less | 0.7 or less | 0.7 or less |
| | Oil Separation % (100 °C. , 24 h) | 1.8 | 2.9 | 3.5 |
| | Copper Corrosion (100 °C., 24 h) | No color change | No color change | No color change |

Exemplary Embodiment 5

Silica Thickener

A silica grease was produced using a distillation residue generated in production of biodiesel, a silica gel thickener, a pour point depressant, a lubricating additive, a corrosion inhibitor, an oxidation inhibitor and a structure stabilizer.

TABLE 5

| Composition and Properties of Grease using Fumed Silica Gel as Thickener | | | | |
|---|---|---|---|---|
| Amount (%) | Name | 1 | 2 | 3 |
| | Fumed Silica Gel | 16.0 | 13.0 | 10.0 |
| | Biodiesel Distillation Residue | 72.0 | 74.0 | 77.0 |
| | Pour Point Depressant | 1.0 | 1.0 | 1.0 |
| | Lubricating Additive | 1.0 | 1.0 | 1.0 |
| | Water-Resistance Additive | 1.0 | 1.0 | 1.0 |
| | Thickener | 8.0 | 9.0 | 9.0 |
| | Etc. | Proper quantity | Proper quantity | Proper quantity |
| Property | Categories | | | |
| | Worked Penetration | 316 | 361 | 405 |
| | Dropping Point (°C.) | None | None | None |
| | 4-ball Test (Shell Method), mm | 0.8 or less | 0.8 or less | 0.8 or less |
| | Oil Separation % (100 °C., 24 h) | 3.3 | 4.2 | 7.8 |
| | Copper Corrosion (100 °C., 24 h) | No color change | No color change | No color change |

The present invention uses a biodiesel distillation residue as base oil of grease so as to provide environmentally friendly grease and obtain recycling benefits of the biodiesel distillation residue, and the environmentally friendly grease may having good lubrication compared to conventional petroleum base oil and be cheaper than a product using vegetable oil or synthetic ester as base oil.

Exemplary embodiments of the present invention have been disclosed herein and, although specific terms are employed, they are used and are to be interpreted in a generic and descriptive sense only and not for purposes of limitation. Accordingly, it will be understood by those of ordinary skill in the art that various changes in form and details may be made without departing from the spirit and scope of the present invention as set forth in the following claims.

What is claimed is:

1. A process for producing a biodegradable grease composition comprising the steps of adding 3 to 20 wt % of additives to 50 to 95 wt % of distillation residues generated in production of biodiesel, and 3 to 30 wt % of thickeners, wherein said production of biodiesel comprises making methyl ester from vegetable oil and distillation of the methyl ester to obtain purified methyl ester, and wherein said distillation residues substantially contain ester.

2. The process according to claim 1, wherein the vegetable oil comprises rice bran oil, waste cooking oil, soybean oil or canola oil, and wherein the distillation residue has a base oil kinematic viscosity of 20 to 400 cSt at 40° C.

3. The process according to claim 1, wherein the thickener comprises at least one selected from the group consisting of lithium soap, diurea, an aluminum complex, a bentone thickener and a silica gel thickener.

4. The process according to claim 3, wherein the lithium soap thickener comprises at least one selected from the group consisting of a lithium hydroxide metal compound, 12-hydroxy stearic, stearic, boric, azelaic, and sebacic acids.

5. The process according to claim 3, wherein the diurea thickener comprises at least one selected from the group consisting of a diisocyanate compound, monoamines such as benzylamine, toluidine and chloroaniline, and aromatic amines such as tetradecylamine, pentadecylamine, hexadecylamine, heptadecylamine, octadecylamine, nonyldecylamine and eicosylamine.

6. The process according to claim 3, wherein the aluminum complex soap thickener is formed of an aluminum metal compound, and at least one selected from the group consisting of benzoic, stearic, palmitic, palmitoleic, and oleic acids.

7. The process according to claim 3, wherein the silica gel thickener is formed of fumed silica, which comprises hydrophobic and hydrophilic silicas and dispersed in the base oil to be used as the grease thickener.

8. The process according to claim 1, wherein the additive comprises at least one selected from the group consisting of: a pour point depressant comprising polymethacrylate, aromatic synthetic base oil and derivatives thereof; a lubricating additive comprising metal salt of dithiocarbamate, aryl phosphate or phosphoric ester, sulfide and derivatives thereof; a corrosion inhibitor comprising benzotriazole, tolyltriazole, mercaptothiazole and derivatives thereof; an oxidation inhibitor comprising tetrabutyl methylphenol, a quinoline compound and derivatives thereof, and a structure stabilizer comprising a copolymer such as ethylene propylene and derivatives thereof.

* * * * *